US011458357B2

(12) United States Patent
Consiglio et al.

(10) Patent No.: US 11,458,357 B2
(45) Date of Patent: Oct. 4, 2022

(54) EXERCISE SYSTEM

(71) Applicant: Peloton Interactive, Inc., New York, NY (US)

(72) Inventors: John Chester Consiglio, New York, NY (US); Alexander Bricknell Chatham, Brooklyn, NY (US); Terry Lee Gonzales, Brooklyn, NY (US)

(73) Assignee: PELOTON INTERACTIVE, INC., New York, NY (US)

( * ) Notice: Subject to any disclaimer, the term of this patent is extended or adjusted under 35 U.S.C. 154(b) by 245 days.

(21) Appl. No.: 16/709,594

(22) Filed: Dec. 10, 2019

(65) Prior Publication Data

US 2021/0170222 A1 Jun. 10, 2021

(51) Int. Cl.

| | |
|---|---|
| ***A63B 22/02*** | (2006.01) |
| ***A63B 24/00*** | (2006.01) |
| ***A63B 71/06*** | (2006.01) |
| ***A63B 21/00*** | (2006.01) |
| ***A63B 21/22*** | (2006.01) |

(52) U.S. Cl.

CPC ..... *A63B 22/025* (2015.10); *A63B 21/154* (2013.01); *A63B 21/225* (2013.01); *A63B 24/0087* (2013.01); *A63B 71/0622* (2013.01); *A63B 2071/0625* (2013.01); *A63B 2071/0658* (2013.01); *A63B 2225/66* (2013.01)

(58) Field of Classification Search

None

See application file for complete search history.

(56) References Cited

U.S. PATENT DOCUMENTS

| | | | | |
|---|---|---|---|---|
| 6,436,008 | B1 * | 8/2002 | Skowronski | A63B 22/02 482/54 |
| 6,471,622 | B1 * | 10/2002 | Hammer | A63B 22/0023 482/54 |
| 9,707,447 | B1 * | 7/2017 | Lopez Babodilla | A63B 22/025 |
| 10,058,730 | B2 * | 8/2018 | Athey | A63B 22/0228 |
| 2016/0287930 | A1 * | 10/2016 | Moser | A63B 24/0087 |
| 2018/0036585 | A1 * | 2/2018 | Powell | A63B 22/025 |
| 2018/0043207 | A1 * | 2/2018 | Moser | A63B 24/0087 |
| 2018/0126249 | A1 * | 5/2018 | Consiglio | A63B 22/025 |
| 2018/0140903 | A1 * | 5/2018 | Poure | A63B 23/0405 |
| 2018/0178055 | A1 * | 6/2018 | Netter | A63B 22/02 |
| 2019/0336827 | A1 | 11/2019 | Intonato et al. | |

FOREIGN PATENT DOCUMENTS

| | | | |
|---|---|---|---|
| CN | 105661991 A | * | 6/2016 |
| TW | 201538203 A | | 10/2015 |

* cited by examiner

*Primary Examiner* — Sundhara M Ganesan
*Assistant Examiner* — Shila Jalalzadeh Abyaneh
(74) *Attorney, Agent, or Firm* — AMPACC Law Group, PLLC

(57) ABSTRACT

A deck for a treadmill includes a continuous belt, and a plurality of rollers engaging the continuous belt. The continuous belt and rollers at least partly define cavity of the deck. The deck also includes a first motor configured to modify a position of the deck relative to a support surface on which the deck is supported, and a second motor configured to modify a speed of rotation of the track. The first motor and the second motor are disposed within the cavity.

20 Claims, 15 Drawing Sheets

EXERCISE SYSTEM

FIELD

This application relates generally to the field of exercise equipment and methods associated therewith. In particular, this application relates to an exercise system configured to provide a compact form factor to one or more users.

BACKGROUND

Exercise has become an increasingly important aspect of daily life, and most exercise regimens commonly involve the use of elliptical machines, stationary bicycles, rowing machines, treadmills, or other exercise machines. Such exercise machines are typically designed for use in a gym or other exercise facility and may not be concerned with an overall size or formfactor. For example, a treadmill may have a motor and controls located in front of a deck where a user may run or walk. This configuration may provide accessibility to the motor and/or controls for maintenance purposes.

Additionally, the exercise machines may be configured such that a user can participate in various exercise classes, training programs, or other activities using such machines. In particular, such exercise machines generally provide the user with one or more buttons, switches, knobs, levers, or other mechanisms that enable the user to control various parameters of the exercise machine during use. For instance, a treadmill may include one or more controls dedicated to increasing and decreasing an incline of the treadmill deck, increasing and decreasing a speed of the treadmill belt, or modifying other parameters of the treadmill as the user walks, jogs, sprints, or performs various other activities on the treadmill. Similarly, a stationary bicycle may include one or more controls dedicated to increasing and decreasing a braking resistance of a flywheel of the bicycle, increasing and decreasing a pedal speed or cadence of the bicycle, or modifying other parameters of the stationary bicycle during use.

While such controls are commonplace on treadmills, stationary bicycles, elliptical machines, and other known exercise machines, such controls can be challenging to use in some situations. For example, due to the dynamic nature of the motion-based activities typically performed on such exercise machines (e.g., running, cycling, etc.), it can be difficult for a user to manipulate such controls during a workout. Moreover, even if a user is able to manipulate such controls while running, cycling, or performing other motion-based activities, such controls may not be optimized for enabling the user to select a particular setting or other parameter of the exercise machine, with accuracy, as such motion-based activities are being performed.

Example embodiments of the present disclosure are directed toward addressing one or more of the deficiencies of known exercise machines noted above.

SUMMARY

In an example embodiment of the present disclosure, a deck for an exercise machine includes a continuous belt. The continuous belt is rotatable about a first roller disposed at a first end and at least partly defines a cavity of the deck. The continuous belt is rotatable about a second roller disposed at a second end of the cavity which is opposite the first end. The second roller at least partly defines the cavity of the deck. The deck also includes a first motor configured to modify a position of the deck relative to a support surface on which the deck is supported, and a second motor configured to modify a speed of rotation of the belt. The first motor and the second motor are disposed in the cavity of the deck.

In another example embodiment of the present disclosure, a treadmill includes a deck, an upper assembly connected to the deck and includes a crossbar. The treadmill also includes a display supported by the crossbar, and a controller operably connected to the deck and the display. In such an example, the deck includes a continuous belt, that is rotatable about a first roller disposed at a first end and a second roller disposed at a second end. The first roller and the second roller are opposite each other and at least partly define a cavity of the deck. The deck also includes a first motor configured to modify a position of the deck relative to a support surface on which the deck is supported, and a second motor configured to modify a speed of rotation of the belt. The first motor and the second motor are disposed in the cavity of the deck.

In another example embodiment of the present disclosure, a method of manufacturing a treadmill, includes providing a substantially rigid frame having a first rail, and a second rail opposite the first rail. The method also includes connecting a least one at least one cross frame member extending from the first rail to the second rail. The method also includes connecting a first motor to the frame, and connecting a second motor to the frame. The method also includes engaging a continuous belt with the second motor. In this example, the continuous belt is rotatable about a first roller disposed at a first end and a second roller disposed at a second end. The first end and the second end opposite each other and at least partly define a cavity of a deck. In this example, the first motor is configured to modify a position of the deck relative to a support surface on which the deck is supported, and the second motor is configured to modify a speed of rotation of the belt. The first motor and the second motor are disposed within the cavity of the deck.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

DETAILED DESCRIPTION

Figure 1:
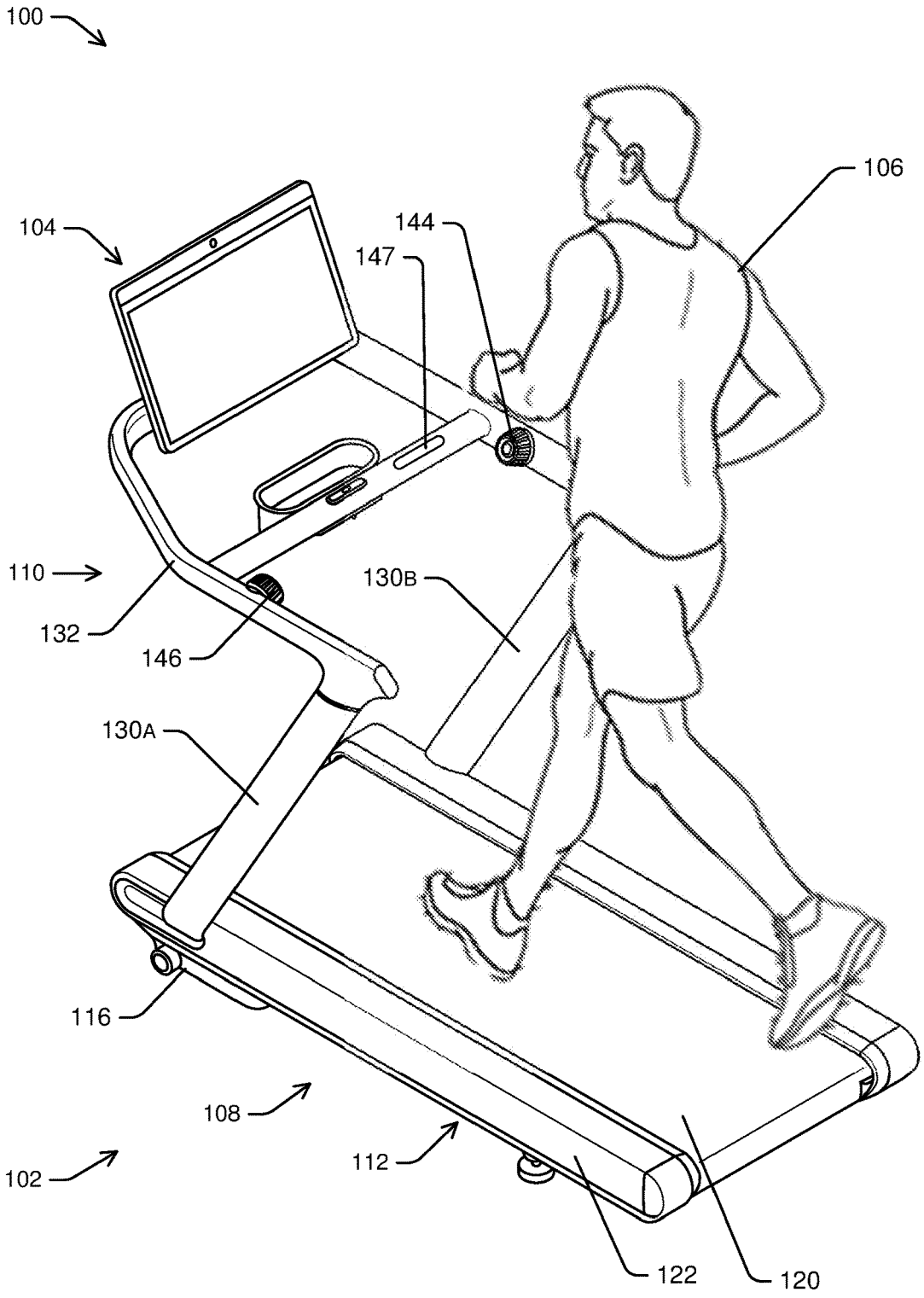
FIG. 1 is a rear perspective view of an exemplary exercise machine as disclosed herein with a user shown.

The following description is presented to enable any person skilled in the art to make and use aspects of the examples described herein. For purposes of explanation, specific nomenclature is set forth to provide a thorough understanding of the present invention. Descriptions of specific embodiments or applications are provided only as examples. Various modifications to the examples will be readily apparent to those skilled in the art, and general principles defined herein may be applied to other examples and applications without departing from the spirit and scope of the present disclosure. Thus, the present disclosure is not intended to be limited to the examples shown, but is to be accorded the widest possible scope consistent with the principles and features disclosed herein.

Examples of the present disclosure include exercise systems whereby the exercise system may include a moving surface that may allow a user to exercise on the machine. By way of a nonlimiting example, the exercise machine may be a treadmill. Traditional treadmills often have a motor and motor controls located in front of an area where a user may run or walk. However, by locating the motors and controllers in front of the area where the user may run or walk, traditional treadmill design must have tradeoffs. For example, if a traditional treadmill has an area sufficiently large enough for a user to run or walk without significantly limiting the user's stride, the overall length of the traditional treadmill may be too long for many applications and/or settings. However, to reduce the overall length of the traditional treadmill, the size of the area for a user to run or walk must be decreased. However, it cannot be decreased too much or the area won't be large enough for a user to use without adversely impacting the user's stride.

Examples of the present disclosure include an exercise system where a motor and/or controller for the exercise machine are located below an area where a user may exercise. In some examples, an overall length of the exercise system may be used substantially for the area that the user may exercise. In this example, a compact form factor may be achieved. In some examples, a compact motor assembly is used and may allow an overall height of the exercise system to be low enough to maintain stability and a relative compact profile.

Exercise Machine

Referring generally to FIGS. 1 through 15, in various examples of the present disclosure, a local system 100 may include an exercise machine 102, such as a treadmill, with integrated or connected digital hardware including one or more displays 104 for use in connection with an instructor lead exercise class and/or for displaying other digital content. While the exercise machine 102 may be described and/or otherwise referred to herein as a "treadmill 102," as noted above, example exercise machines of the present disclosure may be any suitable type of exercise machine, including a rowing machine, stationary bicycle, elliptical trainer, stair climber, etc.

FIG. 1 shows an example exercise machine 102. In various examples, the one or more displays 104 may be mounted directly to the exercise machine 102 or otherwise placed within view of a user 106. In various examples, the one or more displays 104 allow the user 106 to view content relating to a selected exercise class both while working out on the exercise machine 102 and while working out in one or more locations near or adjacent to the exercise machine 102. The exercise machine 102 may also include a hinge, joint, pivot, bracket or other suitable mechanism to allow for adjustment of the position or orientation of the display 104 relative to the user 106 whether they are using the exercise machine 102 or working out near or adjacent to the exercise machine 102.

In examples, the exercise machine 102 may generally include a lower assembly 108, and an upper assembly 110 connected to the lower assembly 108. The lower assembly 108 may generally include a deck 112 of the exercise machine 102 that provides support for the user 106 (e.g., a running surface) while the user 106 is working out on the exercise machine 102, as well as other components of both the lower assembly 108 and the upper assembly 110.

Figure 8:
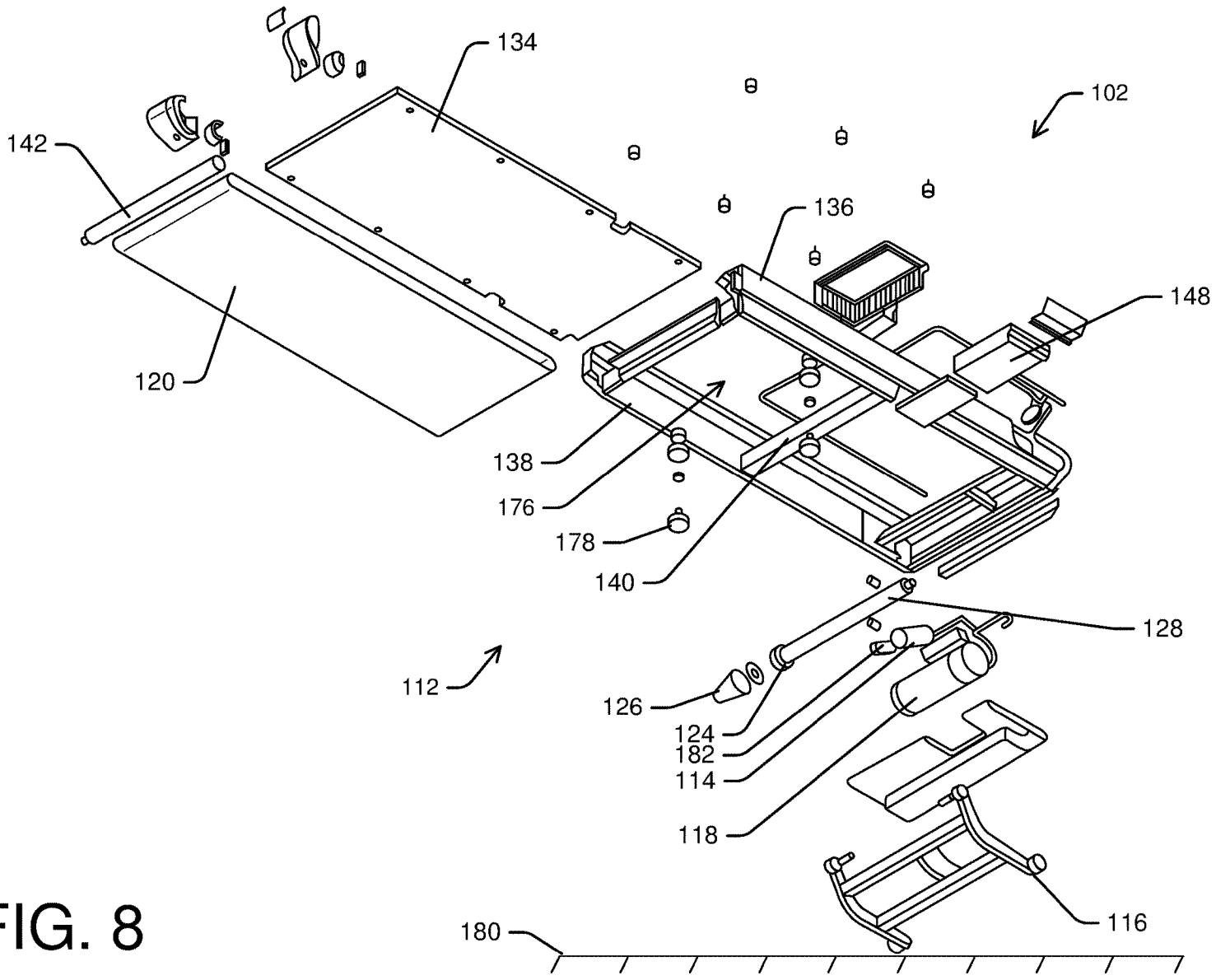
Figure 9:
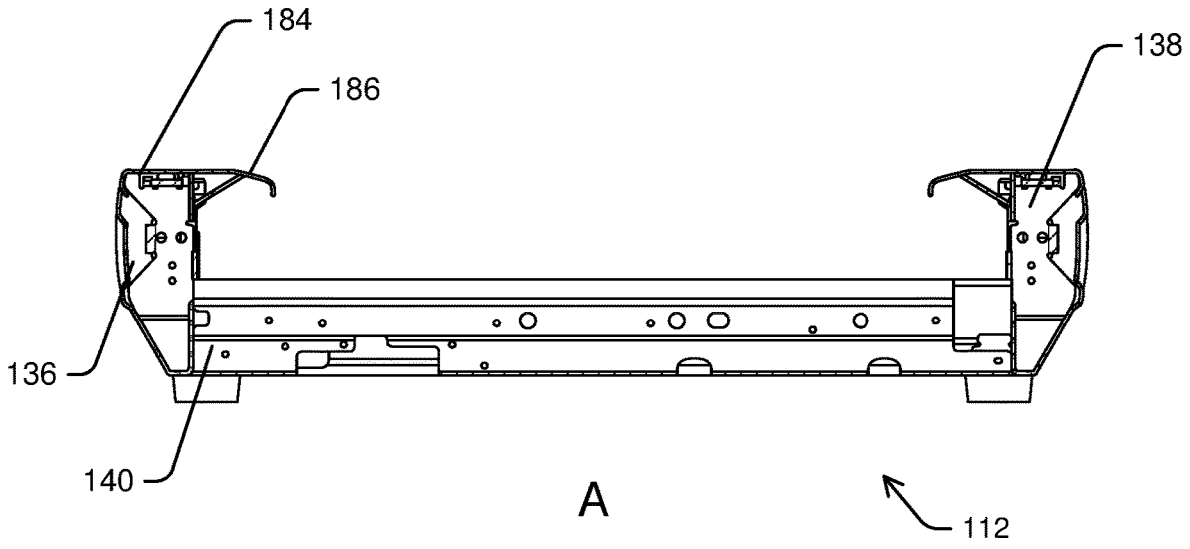
FIG. 9 shows cutaway views of portions of an exemplary exercise machine as disclosed herein.
Figure 9:
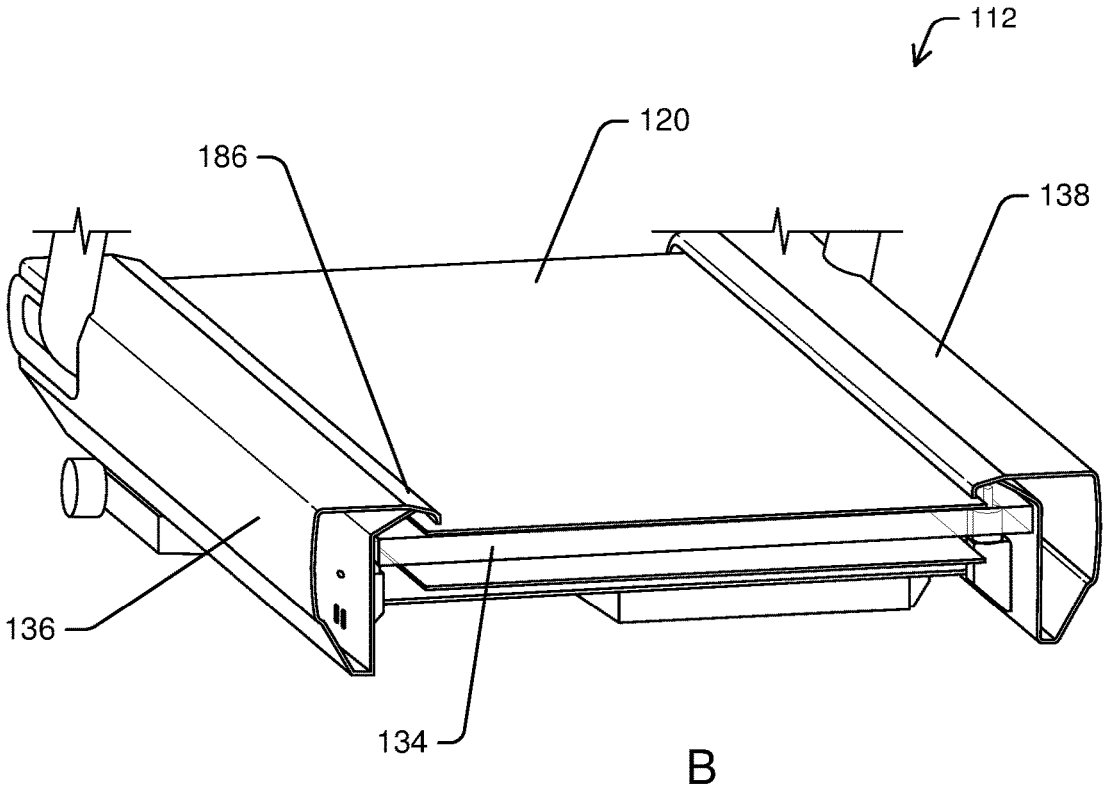
Figure 10:
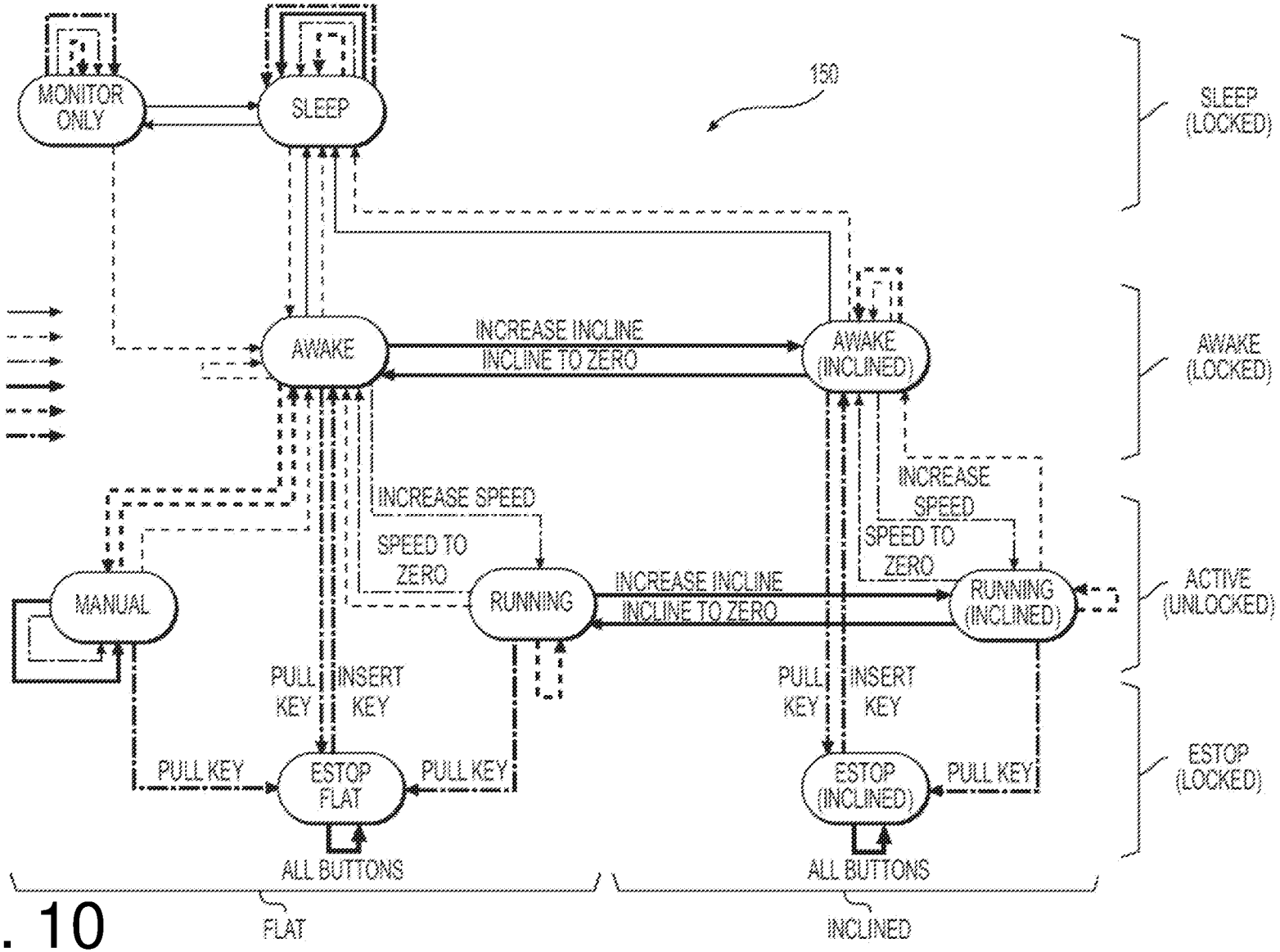
FIG. 10 illustrates a control architecture associated with the example exercise machine shown in FIG. 1.

For example, as shown in at least the exploded view of FIGS. 8 and 9, the deck 112 may support a first motor 114 of the exercise machine 102 configured to increase, decrease, and/or otherwise change an incline of the deck 112, a frame 122 of the deck 112, and/or the running surface relative to a support surface on which the exercise machine 102 is disposed. The deck 112 may also include one or more incline frames 116 coupled to the motor 114 and configured to, for example, raise and lower the deck 112, frame 122 of the deck 112, and/or running surface of the deck 112 by acting on the support surface when the motor 114 is activated. In examples, the frame 122 may be a rigid frame, a substantially rigid frame, or a flexible frame. The deck 112 may also include a second motor 118 configured to increase, decrease, and/or otherwise change a rotational speed of a belt 120 connected to the deck 112. The belt 120 may be rotatable relative to at least part of the deck 112 and, in particular, may be configured to revolve or otherwise move completely around (i.e., encircle) at least part of the deck 112 during use of the exercise machine 102. For example, when the exercise machine 102 comprises a treadmill, the belt 120 may support the user 106 and may repeatedly encircle at least part of one or more rollers 128 and/or table 134 as the user 106 runs, walks, and/or otherwise works out on the treadmill. Such an example deck 112 may include the belt 120 movably coupled to one or more of a gear, flywheel, pulley, and/or other member 124 of the deck 112, and such a member 124 may be coupled to an output shaft or other component of the motor 118, for example, via drive belt 126. In such examples, rotation of the output shaft or other component of the motor 118 may drive commensurate rotation of the member 124. Likewise, rotation of the member 124 may drive commensurate revolution of the belt 120 generally.

The exercise machine 102 may also include one or more posts 130 extending upwardly from the deck 112. For example, the exercise machine 102 may include a first post 130*a* on the left-hand side of the deck 112, and a second post 130*b* on the right-hand side of the deck 112. Such posts 130 may be made from a metal, alloy, plastic, polymer, and/or other like material, and similar such materials may be used to manufacture the deck 112, and/or other components of the exercise machine 102. In such examples, the posts 130 may be configured to support the display 104, and in some examples, the display 104 may be directly coupled to a crossbar 132 of the exercise machine 102, and the crossbar 132 may be connected to and/or otherwise supported by the posts 130. For example, the crossbar 132 may comprise one or more hand rests or handles useful in supporting the user 106 during exercise. In some examples, the crossbar 132 may be substantially C-shaped, substantially U-shaped, substantially A-shaped, and/or any other configuration. In any of the examples described herein, the crossbar 132 may extend from a first one of the posts 130 to a second one of the posts 130. Further, in some examples, the posts 130 and the crossbar 132 may comprise a single integral component of the upper assembly 110. Alternatively, in other examples, the posts 130 and the crossbar 132 may comprise separate components of the upper assembly 110. In such examples, the upper assembly 110 may include one or more brackets, endcaps, and/or additional components configured to assist in coupling the one or more posts 130 to the crossbar 132.

As noted above, the exercise machine 102 may also include a hinge, joint, pivot, bracket and/or other suitable mechanism to allow for adjustment of the position or orientation of the display 104 relative to the user 106 whether the user 106 using the exercise machine 102 or working out near or adjacent to the exercise machine 102.

FIG. 1 also shows that the exercise machine 102 may also include one or more controls 144, 146 configured to receive input from the user 106. The exercise machine 102 may further include one or more sensors 147 configured to sense, detect, and/or otherwise determine one or more performance parameters of the user 106 before, during, and/or after the user 106 participates in an exercise class using the exercise machine 102. In any of the examples described herein, the controls 144, 146 and the one or more sensors 147 may be operably and/or otherwise connected to one or more controllers, processors, and/or other digital hardware 148 of the exercise machine 102.

The digital hardware 148 associated with the exercise machine 102 may be connected to or integrated with the exercise machine 102, or it may be located remotely and wired or wirelessly connected to the exercise machine 102. The digital hardware 148 may include digital storage, one or more processors or other like computers or controllers, communications hardware, software, and/or one or more media input/output devices such as displays, cameras, microphones, keyboards, touchscreens, headsets, and/or audio speakers. In various exemplary embodiments these components may be connected to and/or otherwise integrated with the exercise machine 102. All communications between and among such components of the digital hardware 148 may be multichannel, multi-directional, and wireless or wired, using any appropriate protocol or technology. In various exemplary embodiments, the digital hardware 148 of the exercise machine 102 may include associated mobile and web-based application programs that provide access to account, performance, and other relevant information to users from local or remote exercise machines, processors, controllers, personal computers, laptops, mobile devices, or any other digital device or digital hardware. In any of the examples described herein, the one or more controllers, processors, and/or other digital hardware 148 associated with the exercise machine 102 may be operable to perform one or more functions associated with control logic 150 of the exercise machine 102. Such control logic 150 is illustrated schematically in at least FIG. 10, and such control logic 150 may comprise one or more rules, programs, or other instructions stored in a memory of the digital hardware 148. For example, one or more processors included in the digital hardware 148 may be programmed to perform operations in accordance with rules, programs, or other instructions of the control logic 150, and such processors may also be programmed to perform one or more additional operations in accordance with and/or at least partly in response to input received via one or more of the controls 144, 146 and/or via one or more of the sensors 147.

Figure 11:
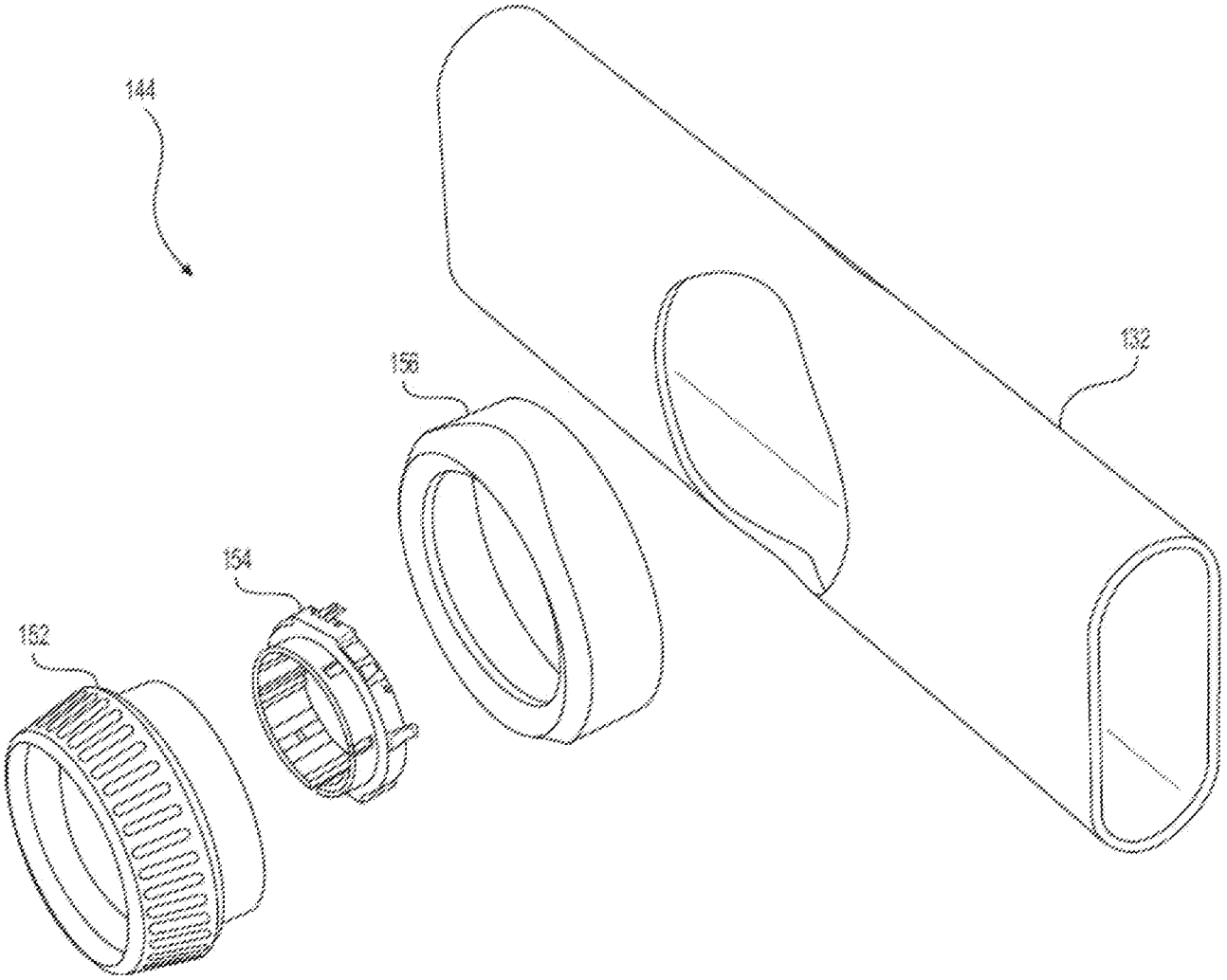
FIG. 11 illustrates an exploded view of a rotary control associated with the example exercise machine shown in FIG. 1.
Figure 12:
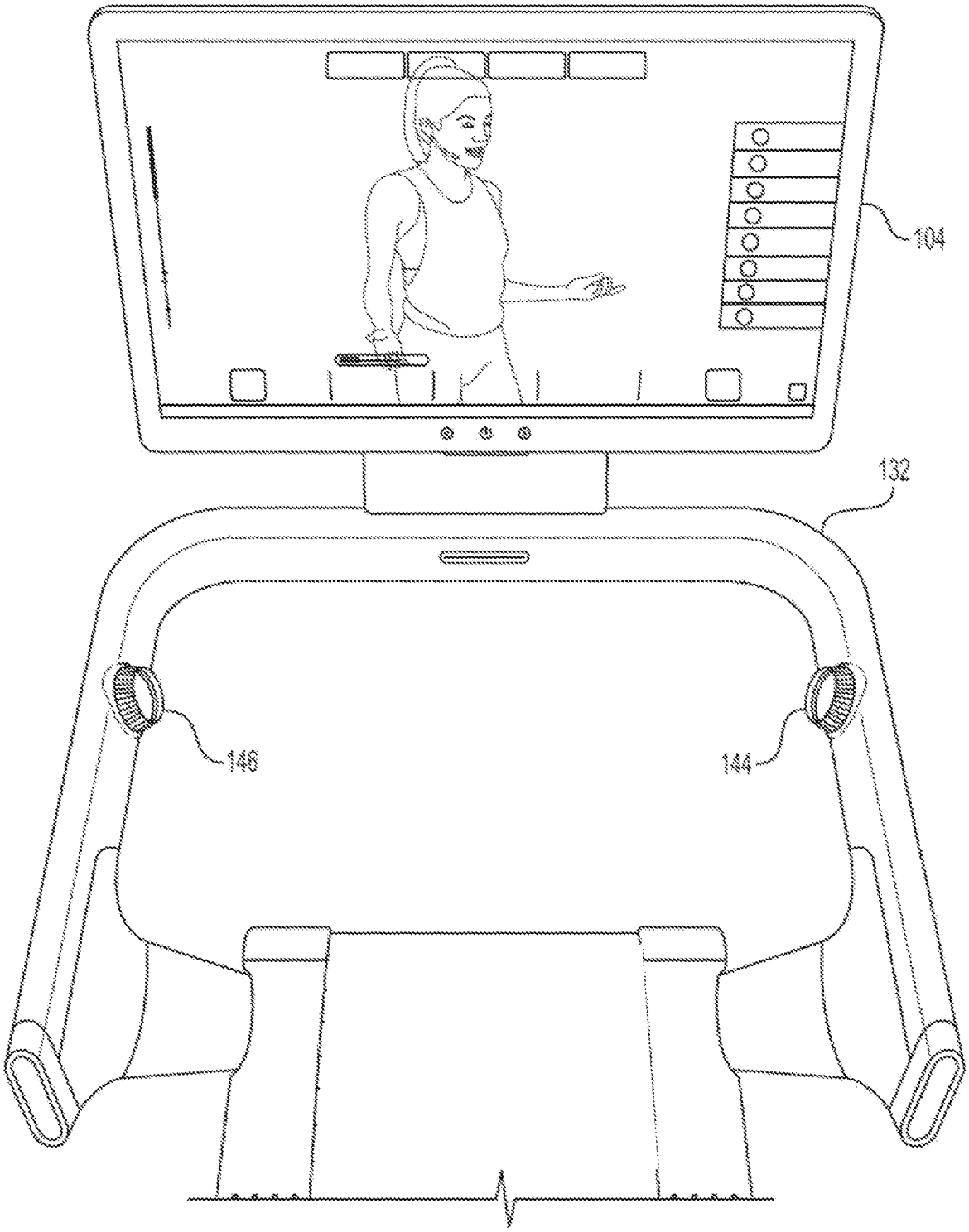
FIG. 12 illustrates another view of the example exercise machine shown in FIG. 1 including first and second rotary controls.

As shown in FIGS. 11 and 12, one or more such controls 144, 146 may comprise an infinity wheel-type control 144. Such a control may be useful in changing and/or otherwise controlling, for example, the incline of the deck 112, the speed of the belt 120, and/or other operations of the exercise machine 102 associated with incremental increases or decreases. In an example embodiment, such a control 144 may include a rotary dial 152 connected to a corresponding rotary encoder 154. In such examples, the rotary encoder 154 may include one or more detents or other components/structures that may be tuned for a desired incremental change in a corresponding functionality of the exercise machine 102. For example, the rotary encoder 154 may be tuned such that each detent thereof may correlate to a 0.5% increase or decrease in an incline angle of the deck 112. Alternatively, the rotary encoder 154 may be tuned such that each detent thereof may correlate to a 0.1 mph increase or decrease in a speed of the belt 120. In still further examples, percentages, speeds, and/or other increments greater than or less than those noted above may be chosen. Additionally, one or more such controls 144, 146 may include one or more additional buttons, wheels, touch pads, levers, knobs, or other components configured to receive additional inputs from the user 106, and such additional components may provide the user 106 with finer control over the corresponding functionality of the exercise machine 102. One or more such controls 144, 146 may also include a respective control housing 156 configured to assist in mounting the control 144, 146 to the crossbar 132 or other components of the exercise machine 102.

Figure 13:
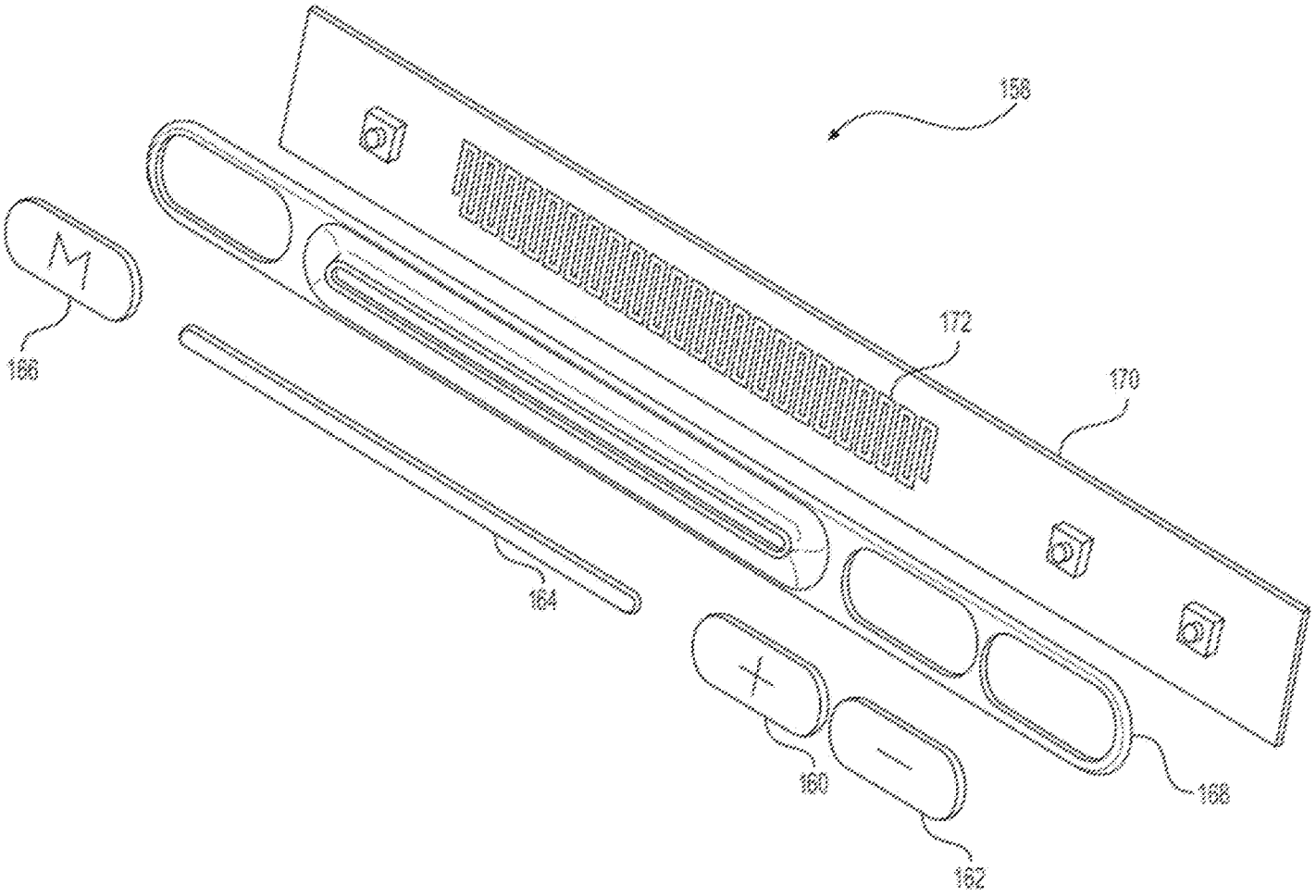
FIG. 13 illustrates an exploded view of a substantially linear control associated with an exemplary exercise machine as disclosed herein.
Figure 14:
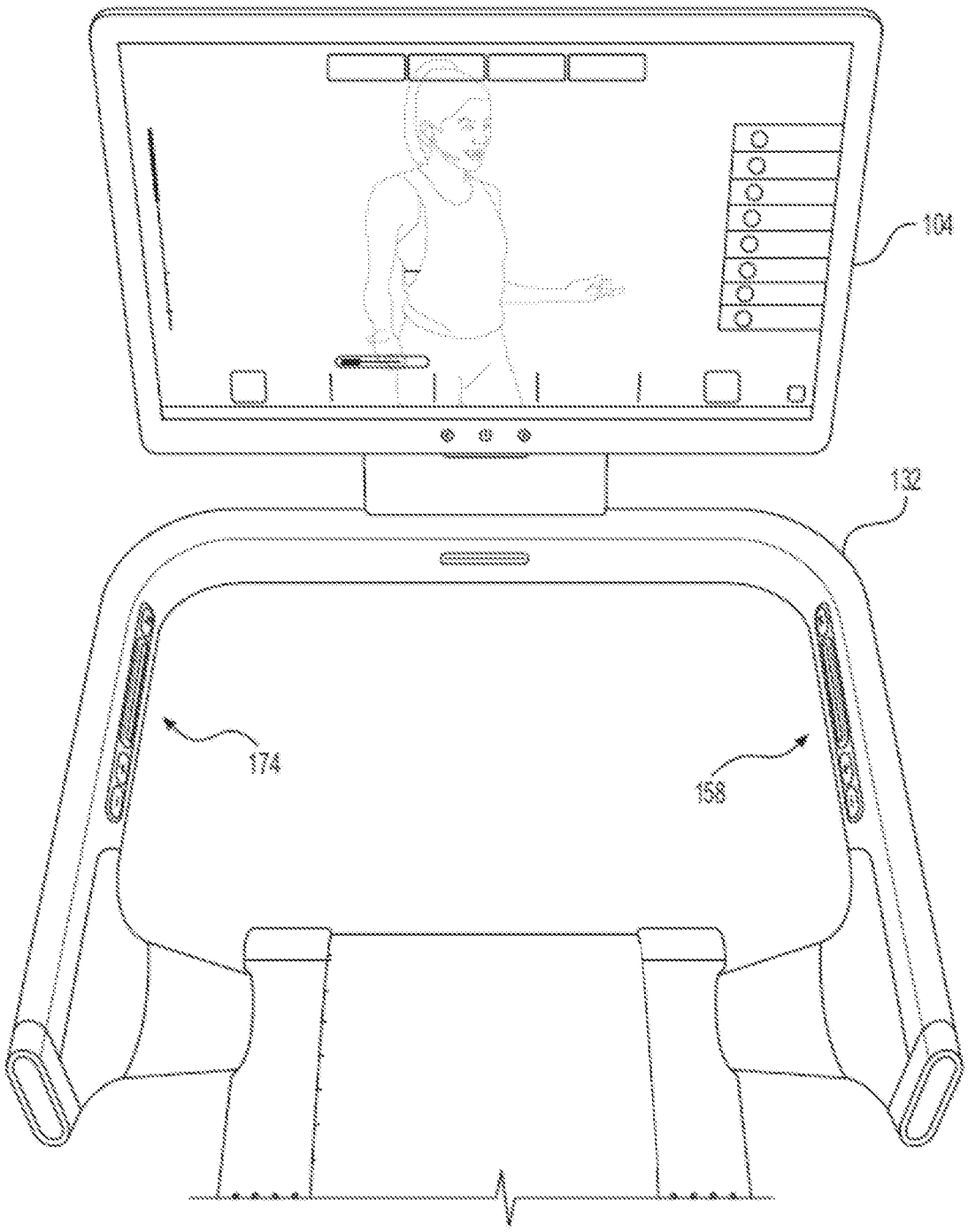
FIG. 14 illustrates another view of an exemplary exercise machine including first and second substantially linear controls.
Figure 15:
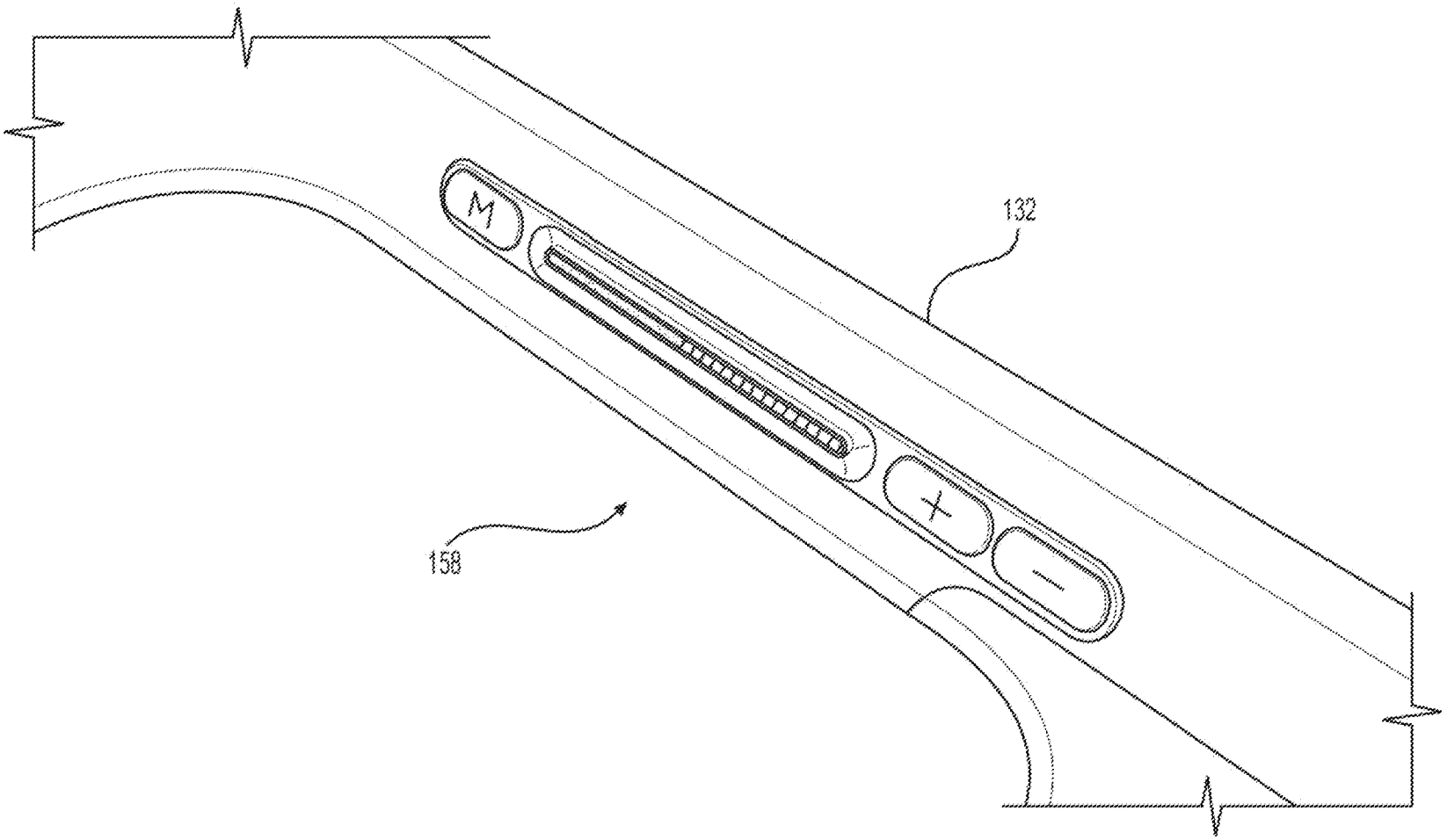
FIG. 15 illustrates a portion of an exemplary exercise machine as disclosed herein including a substantially linear control.

As shown in FIGS. 13-15, in still further embodiments one or more of the infinity wheel-type controls 144, 146 described herein may be replaced with a capacitive slider-type control and/or other substantially linear control 158. Such controls 158 may include one or more touch pads, buttons, levers, and/or other components 160, 162, 166 configured to receive a touch, tap, push, and/or other input from the user 106. Such components 160, 162, 166 may be operably connected to respective touch and/or tactile switches of the control 158 mounted to a printed circuit board 170 thereof. Such tactile switches may be configured to generate signals indicative of the input received via such components 160, 162, 166, and to direct such signals to the processor and/or other digital hardware 148 associated with the exercise machine 102. The controls 158 may also include one or more additional touch pads 164 having a substantially linear configuration. Such touch pads 164 may also be configured to receive a touch, tap, push, and/or other input from the user 106. Additionally, the touch pads 164 may be operably connected to a respective capacitive trace 172 of the control 158 mounted to the printed circuit board 170. In such examples, the capacitive trace 172 may be configured to generate signals indicative of the input received via the touch pad 164 and to direct such signals to the processor and/or other digital hardware 148 associated with the exercise machine 102.

FIG. 14 illustrates a first substantially linear control 158 disposed on the right-hand side of the crossbar 132, and a second substantially linear control 174 disposed on the left-hand side of the crossbar 132 opposite the control 158. In any of the examples described herein, one or more of the components 160, 162, 166 may be operable to control and/or change operating modes of the exercise machine 102. Additionally, in any of the examples described herein, one or more of the infinity wheel-type controls 144, 146 and/or one or more of the substantially linear controls 158, 174 may include light emitting diodes and/or other lighting indicating a change in operation that is affected by the respective control. Additionally or alternatively, in any of the examples described herein, one or more of the infinity wheel-type controls 144, 146 and/or one or more of the substantially linear controls 158, 174 may include an audible device, for example, a speaker, piezoelectric device, magnetic device, among others, and/or sound creating devices indicating a change in operation that is affected by the respective control. Additionally or alternatively, in any of the examples described herein, one or more of the infinity wheel-type controls 144, 146 and/or one or more of the substantially linear controls 158, 174 may include a haptic feedback device, for example, a shaker, motor, ultrasound, among others, and/or haptic creating devices indicating a change in operation that is affected by the respective control.

Additionally or alternatively, in any of the examples described herein, one or more of the infinity wheel-type controls 144, 146 and/or one or more of the substantially linear controls 158, 174 may send a signal to the one or more controllers, processors, and/or other digital hardware 148 associated with the exercise machine 102, and the processor causes a speaker on the treadmill to emit a tone or sound indicating a change in operation that is affected by the respective control.

With continued reference to at least FIG. 1, in various exemplary embodiments, the sensors 147 of the exercise machine 102 may be configured to sense, detect, measure, and/or otherwise determine a range of performance metrics from both the exercise machine 102 and the user 106, instantaneously and/or over time. For example, the exercise machine 102 may include one or more sensors 147 that measure the incline of the deck 112, the speed of the belt 120, a load applied to the deck 112, the belt 120, one or more of the motors 114, 118, and/or other components of the exercise machine 102, an amount of energy expended by the user 106, a power output of the exercise machine 102, user weight, steps, distance, total work, repetitions, an amount of resistance applied to the belt 120 by one or more of the motors 114, 118 and/or other components of the exercise machine 102, as well as any other suitable performance metric associated with, for example, a treadmill.

The exercise machine 102 may also include sensors 147 to measure user heart-rate, respiration, hydration, calorie burn, or any other physical performance metrics, or to receive such data from sensors provided by the user 106. Where appropriate, such performance metrics can be calculated as current/instantaneous values, maximum, minimum, average, or total over time, or using any other statistical analysis. Trends can also be determined, stored, and displayed to the user, the instructor, and/or other users. Such sensors 147 may communicate with memory and/or processors of the digital hardware 148 associated with the exercise machine 102, nearby, or at a remote location, using wired or wireless connections. In various exemplary embodiments, the exercise machine 102 may also be provided with one or more indicators to provide information to the user 106. Such indicators may include lights, projected displays, speakers for audio outputs, or other output devices capable of providing a signal to a user 106 to provide the user 106 with information such as timing for performing an exercise, time to start or stop exercise, or other informational indicators. For example, such indicators (e.g., lights or projected displays) could display information regarding the number of sets and repetitions performed by the user 106 at a location where it can be seen by the user 106 during the performance of the relevant exercise. For example, a control coupled to the controller, for example digital hardware 148, may be configured to transmit a signal to the controller for controlling the first motor or the second motor, the control having an audio indication, the audio indication being activated in response to the control being adjusted by a user.

Figure 2:
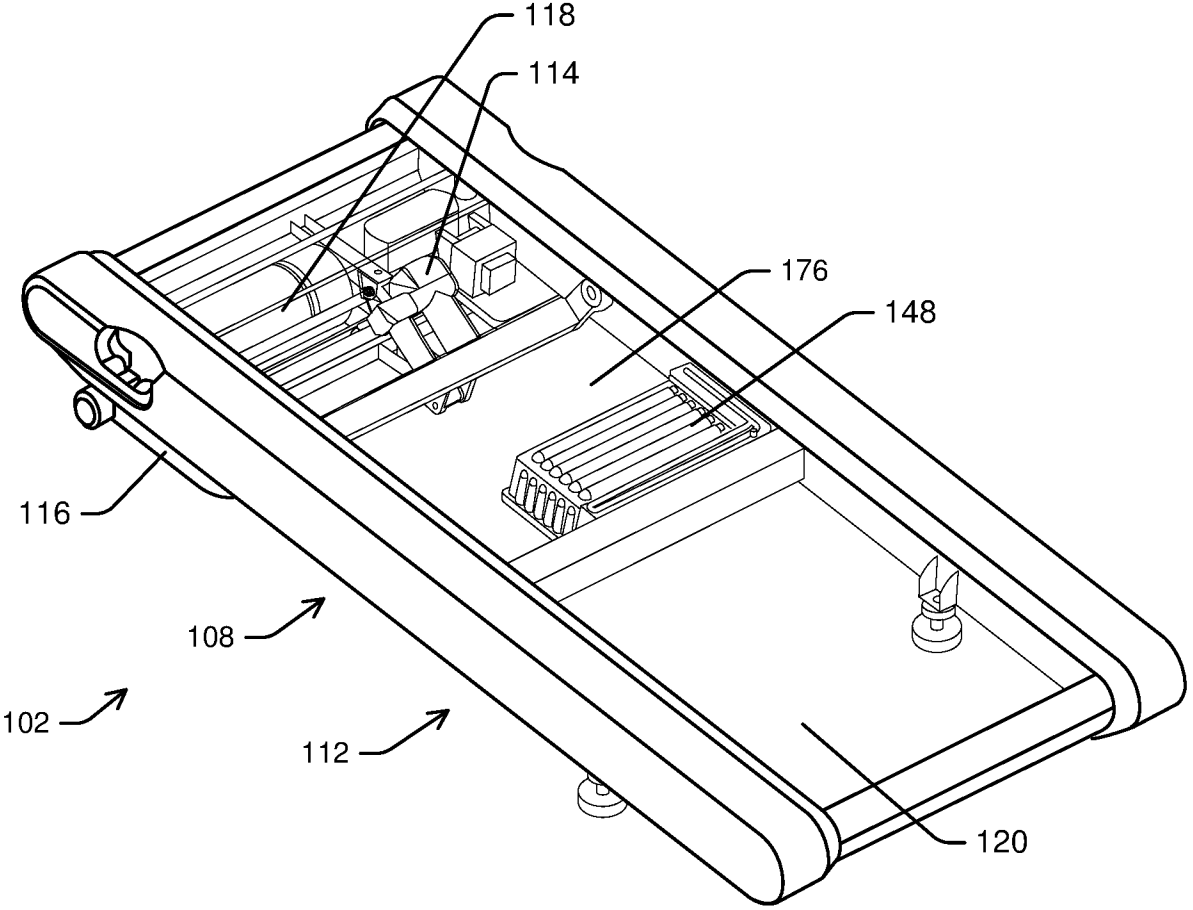
FIG. 2 is a rear perspective view of a portion of an exemplary exercise machine as disclosed herein.

FIG. 2 shows an example of the lower assembly 108 with several portions made transparent. In this example, the belt 120 is shown as transparent exposing a cavity 176 as will be discussed further below. FIG. 2 shows that the deck 112 supports the first motor 114 of the exercise machine 102 in the cavity 176 where the first motor 114 is configured to increase, decrease, and/or otherwise change an incline of the deck 112, a frame 122 of the deck 112, and/or the running surface relative to a support surface on which the exercise machine 102 is disposed. FIG. 2 also shows that the deck 112 includes one or more incline frames 116 coupled to the motor 114 and configured to, for example, raise and lower the deck 112, frame 122 of the deck 112, and/or running surface of the deck 112 by acting on the support surface when the motor 114 is activated. In this example, the deck 112 also includes the second motor 118 in the cavity 176 where the second motor 118 is configured to increase, decrease, and/or otherwise change a rotational speed of the belt 120. FIG. 2 also shows digital hardware 148 located in the cavity 176 and configured to control at least the first motor 114 and the second motor 118.

Figure 4:
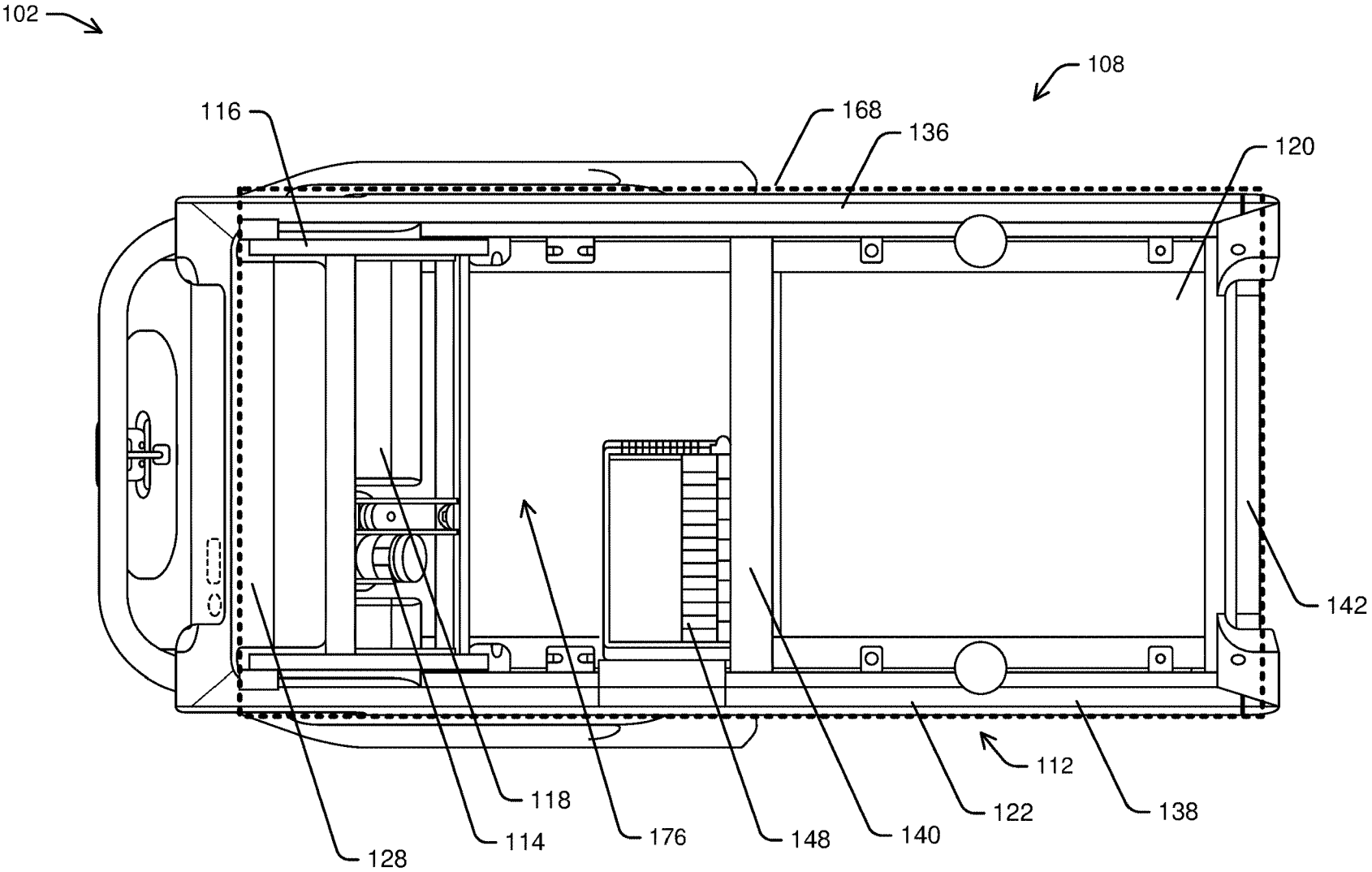
FIG. 4 is a bottom view of an exemplary exercise machine as disclosed herein.

FIG. 4 shows a view from below exercise machine 102. For example, FIG. 4 the shows deck 112 including the frame 122. In various examples, the frame 122 may include a first rail 136 coupled to a second rail 138 through one or more cross frame members 140. In various examples, deck 112 may include rollers 128, 142 located at each end of the rails. For example, roller 128 may be located at a first end of rail 136 and a first end of rail 138 and may be rotatably supported by the first ends. Similarly, a second roller 142 may be located at a second end of rail 136 and a second end of rail 138 and may be rotatably supported by the second ends where the roller 128 and roller 142 are substantially opposite one another. In various examples, outer edges of the first rail 136, second rail 138, roller 128, and roller 142 define a perimeter of an area 168 of the deck 112. The area 168 may be projected above or below surfaces of the deck 112. For example, the area projected above the deck 112 includes an area where user 106 may be located when operating exercise machine 102 and the area projected below the deck 112 includes an area below the deck 112 where the exercise machine 102 interacts with the support surface, for example, through the incline frame 116.

Additionally or alternatively, in some examples, the rails 136, 138 have a height that is greater than the rollers 128, 142 and/or table 134. In this example, the rails 136, 138 in conjunction with the area 168 and/or a projection of the area 168 define a cavity 176. For example, the cavity 176 includes a volume of the area 168 across the height of the rails 136, 138.

FIG. 4 shows the exercise machine 102 where the first motor 114 and/or the second motor 118 are disposed within the cavity 176. Additionally or alternatively, FIG. 4 shows the exercise machine 102 having the digital hardware 148 disposed within the cavity 176. In this example, the digital hardware 148 is accessible through the second rail 138. For example, the digital hardware 148 may be located in a control cavity, where the control cavity is disposed at least partially in one or more of the first rail or the second rails.

Figure 3:
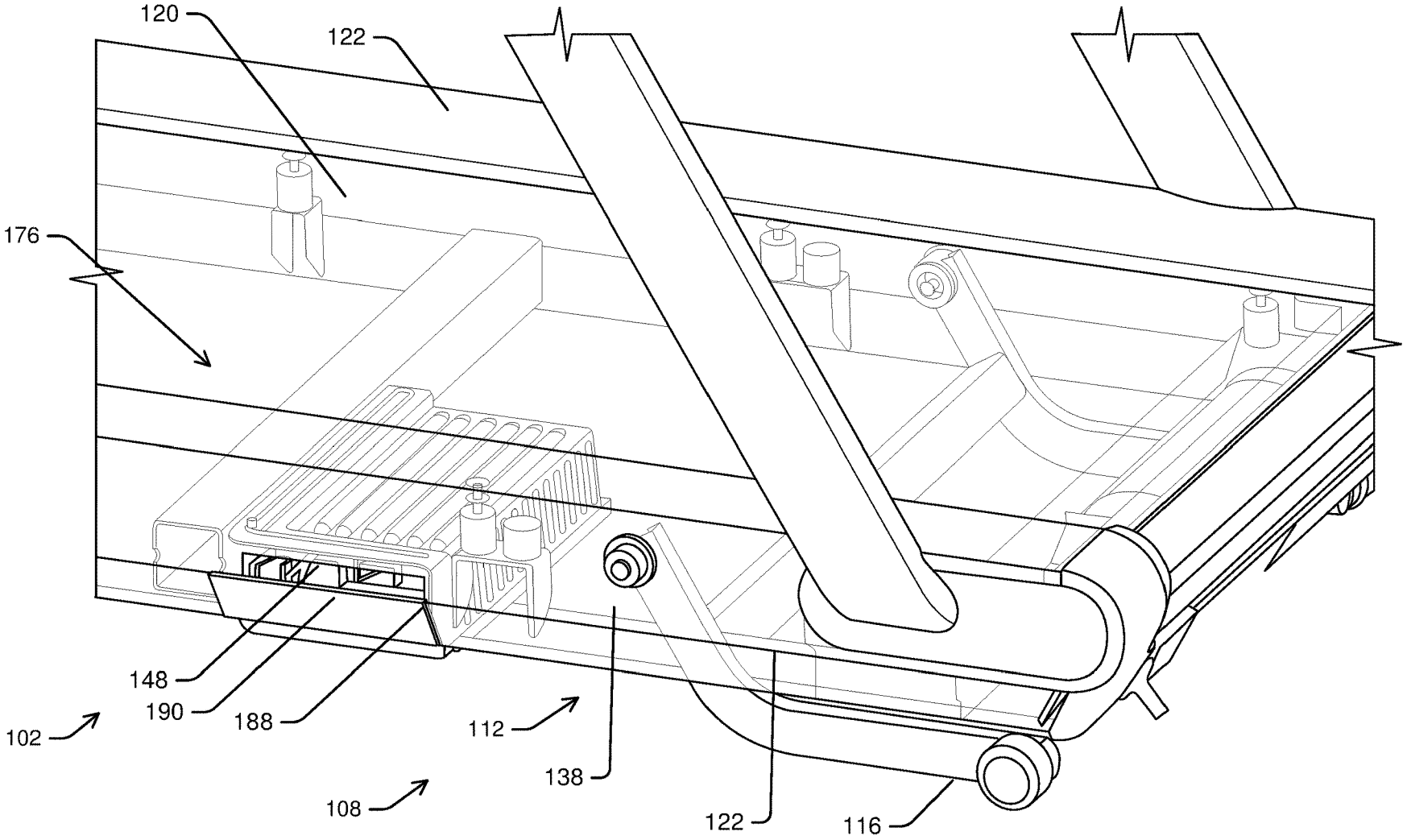
FIG. 3 is a perspective view of a portion of an exemplary exercise machine as disclosed herein with portions shown as transparent.

FIG. 3 shows another view of the digital hardware 148 being disposed within the cavity 176. In this example, the digital hardware 148 is disposed within a cavity 188 within frame 122, for example, in the second rail 138. In various examples, the digital hardware 148 may further be disposed in a drawer 190. In some example, the drawer 190 is configured to transport at least a portion of the digital hardware 148 through the cavity 188. The drawer 190 may be configured to protect the digital hardware 148 when being accessed and/or when the digital hardware 148 is stowed in the cavity 176, for example, when the exercise machine 102 is in use. In examples, the digital hardware 148 may be accessible through an opening in one or more of the rails.

Figure 5:
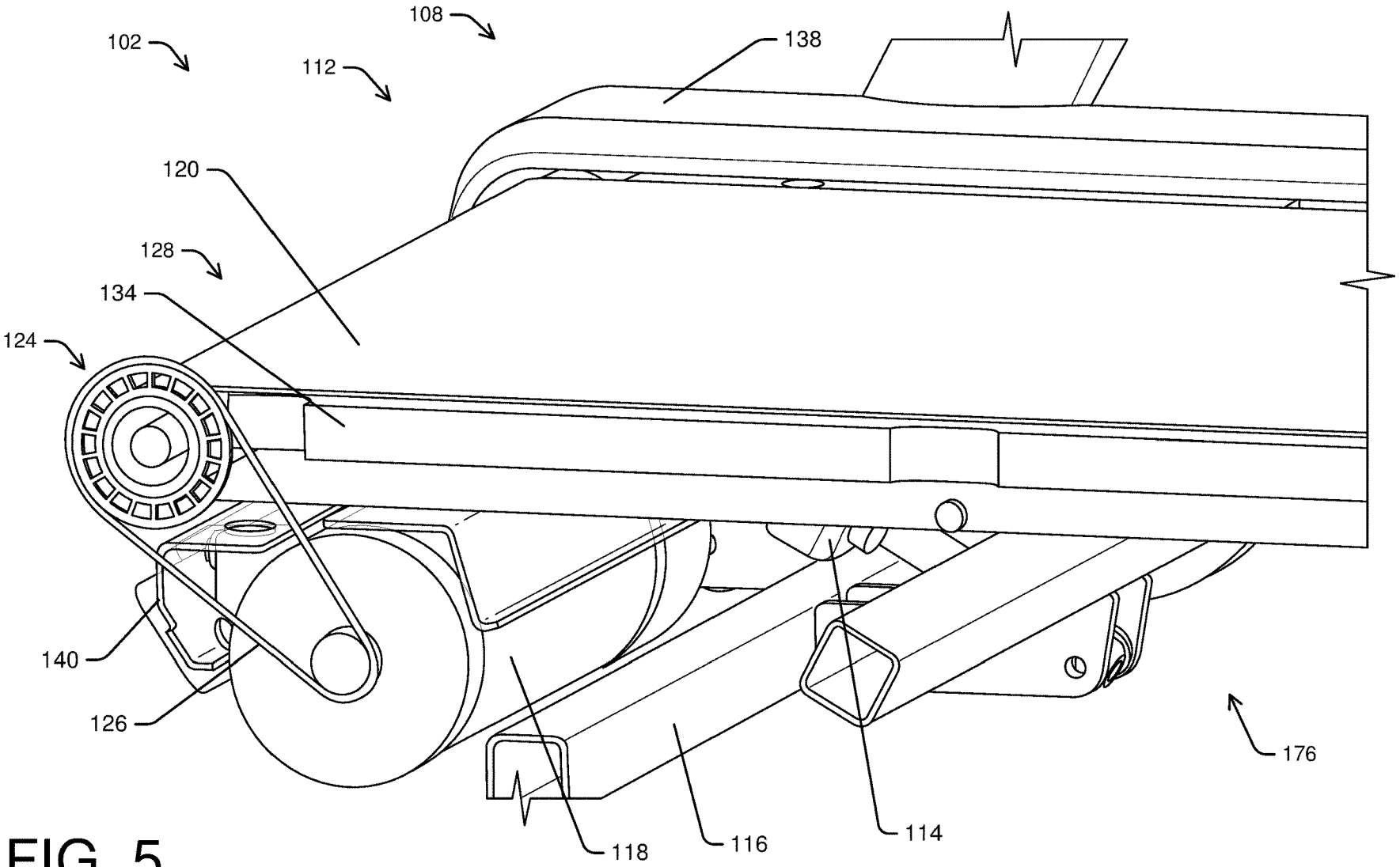
FIG. 5 is a perspective view of a portion of an exemplary exercise machine as disclosed herein.

FIG. 5 shows another view of exercise machine 102 with railing 136 removed for clarity. In this example, the second motor 118 is disposed within cavity 176 and mounted to frame 122 and operably coupled to roller 128. In this example, Additionally or alternatively, the first motor 114 is disposed within cavity 176, coupled to frame 122, and operably coupled to the incline frame 116. In some examples, at least part of the incline frame 116 extends external to the cavity 176 and acts on a support surface, for example, the ground, to modify the position of the deck 112.

Figure 6:
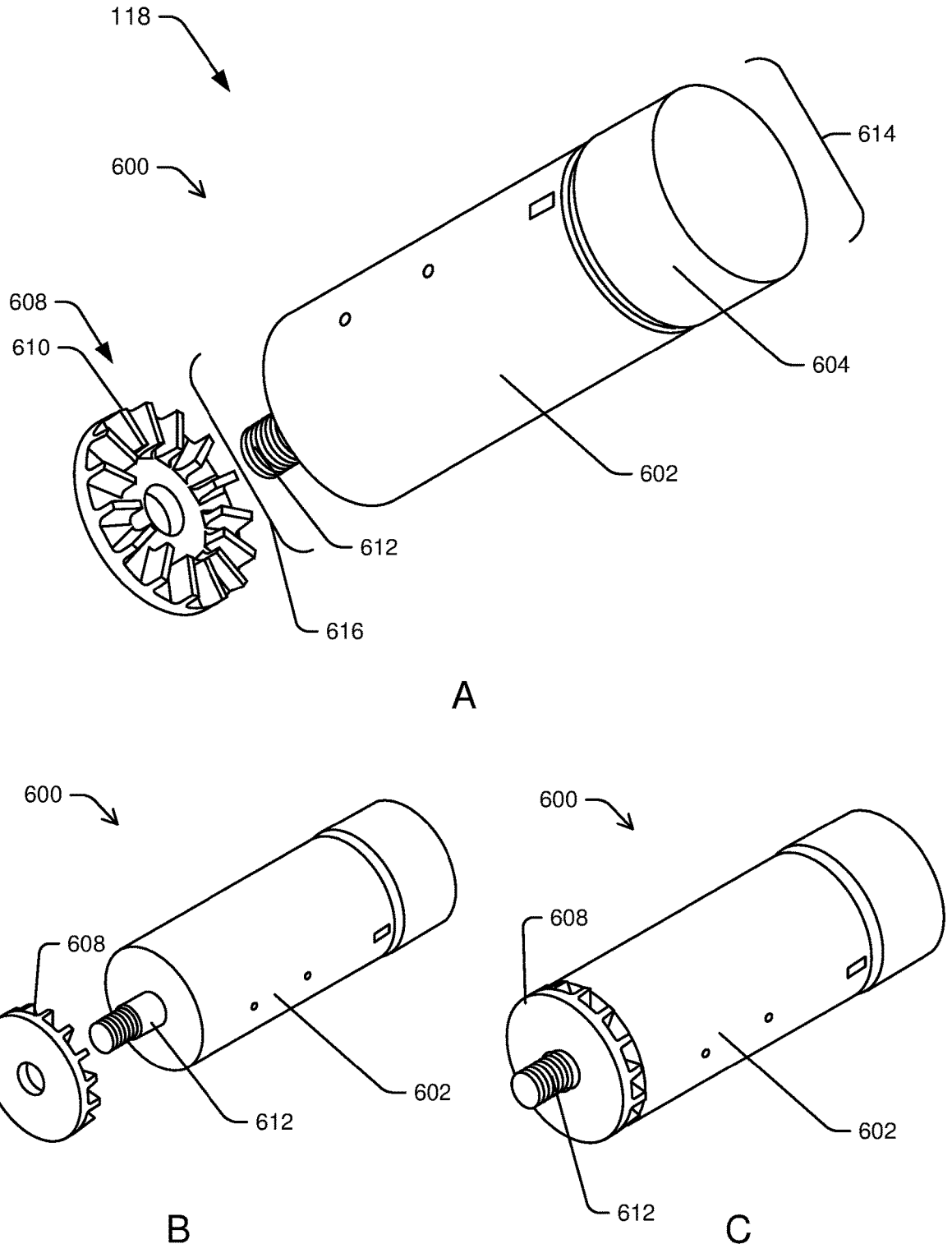
FIG. 6 shows perspective view of exemplary motor assembly as disclosed herein.

FIG. 6 shows an example of the second motor 118. In various examples, second motor 118 includes motor assembly 600. In this example, the motor assembly 600 includes a motor body 602 coupled to a first flywheel 604 on a first end of the motor body 602 and a second flywheel 608 on a second end of the motor body 602. In some examples, the second flywheel 608 may include a cooling feature, for example, cooling structures 610. In some examples, cooling structures 610 are configured to move air across and/or through motor body 602 to provide a cooling effect. In various examples, cooling structures 610 may take the form of an impeller, fan, vanes, or combinations thereof, among others. In some examples, the cooling structure 610 may be configured to cause air to flow across the one or more pieces of hardware. For example, the cooling structure 610 may cause air to flow across the motor body 602. Additionally or alternatively, the second flywheel 608 may be coupled to the motor body 602 through a driveshaft 612. Additionally or alternatively, in some examples, the driveshaft 612 may extend through the motor body 602 and may couple to the first flywheel 604. In any of these examples, the driveshaft 612 may be configured to spin the first and or second flywheels at a rate suitable to move belt 120 at a rate desired by the user 106.

In various examples, the first and second flywheels have a flywheel diameter 614. In some examples, the flywheel diameter 614 is equal to, substantially the same as, or less than a motor body diameter 616. In some examples, the flywheel diameter 614 is less than 10% larger than the motor body diameter 616. In some examples, the flywheel diameter 614 is less than a depth or height of cavity 176. In some examples, the flywheel diameter 614 allows the second motor 118 to fit entirely within the cavity 176. In some examples, the flywheel diameter 614 allows the second motor 118 to protrude less than 10% of the flywheel diameter 614 from the cavity 176.

In various examples, the first flywheel 604 is larger than the second flywheel 608. In some examples, the first flywheel 604 is smaller than the second flywheel 608. In some examples, the first flywheel 604 and the second flywheel 608 are the same size.

In various examples, the first flywheel 604 has a larger or greater mass than the second flywheel 608. In some examples, the first flywheel 604 has a smaller or lower mass than the second flywheel 608. In some examples, the first flywheel 604 and the second flywheel 608 have the same mass.

In various examples, the first flywheel 604 has a larger moment of inertia than the second flywheel 608. In some examples, the first flywheel 604 has a smaller moment of inertia than the second flywheel 608. In some examples, the first flywheel 604 and the second flywheel 608 have the same moment of inertia.

In various examples, the configuration of the first flywheel 604 and the second flywheel 608, for example, the size and weight of each, is driven by the overall kinematics of the exercise machine 102. For example, the flywheels may be designed to keep the belt 120 at a desired speed where acceleration and jerk of the belt 120 below desired levels especially while user 106 is using the exercise machine 102. In some examples, factors that may influence the sizing of the flywheels includes one or more of the size and the power of the second motor 118, the maximum incline, the maximum weight of the user 106, the frictional force between the belt 120 and the table 134, the size of the member 124 and/or drive belt 126.

FIG. 6 also shows the second flywheel 608 being installed onto driveshaft 612. For example, at A, the second flywheel is not coupled to the motor body 602. At B, the second flywheel 608 is aligned axially with driveshaft 612. At C, the second flywheel 608 is seated on driveshaft 612

Figure 7:
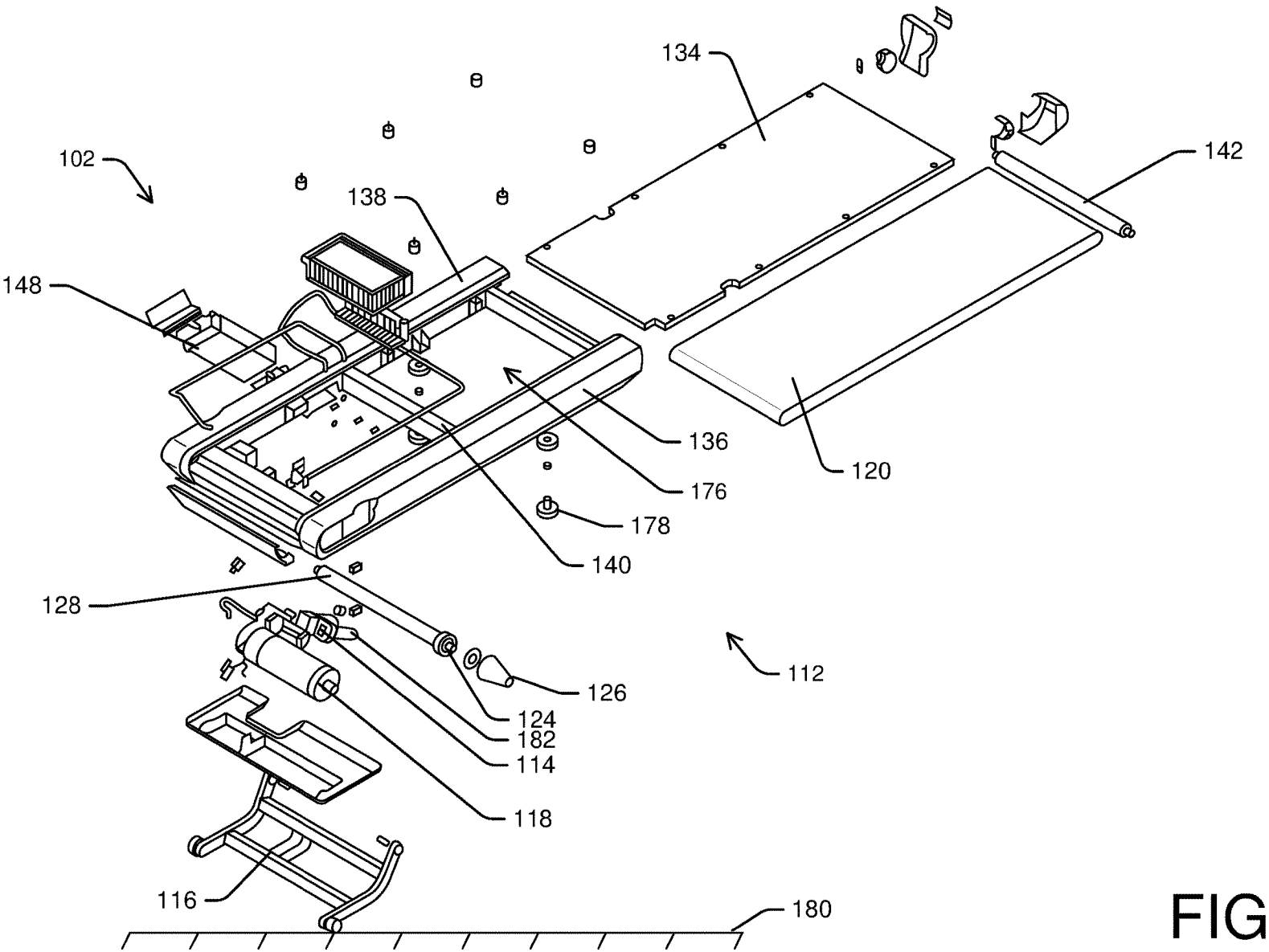
FIGS. 7 and 8 show exploded views of exemplary exercise machines as disclosed herein.

FIGS. 7 and 8 illustrate various components of the example deck 112 described above with respect to at least FIGS. 1-5 in further detail. For example, as shown in FIG. 7, an example deck 112 of the present disclosure may include a frame 122 configured to support components of the deck 112, the lower assembly 108, and/or the upper assembly 110. In such examples, the frame 122 of the deck 112 may comprise a substantially rigid support structure made from steel, aluminum, cast iron, and/or any other metal or alloy. Further, the frame 122 may include one or more components connected together, such as by one or more bolts, screws, weldments, solder joints, and/or other means. For example, the frame 122 may include a first rail 136 and a second rail 138 disposed opposite the first rail 136. The first and second rails 136, 138 may comprise substantially rigid structures configured to support the weight of the upper assembly 110 and the lower assembly 108. The first and second rails 136, 138 may also be configured to support the weight of one or more users 106 standing, walking, and/or running on a substantially planar running surface defined by belt 120 of the deck 112.

In any of the examples described herein, at least one of the motors 114, 118 may be mounted on, supported by, fixedly attached to, and/or otherwise connected to a component of the frame 122. For example, the frame 122 may also include one or more cross frame members 140. In still further examples, each of the cross frame members 140 may extend from the first rail 136 to the second rail 138. Cross frame members 140 described herein may be formed from any of the materials described above with respect to the frame 122. Further, one or more of the cross frame members 140 may be connected to, for example, at least one of the rails 136, 138 via one or more bolts, screws, weldments, solder joints, and/or other means. In such examples, at least one of the motors 114, 118 may be connected to a cross frame member 140 of the frame 122. In further examples, the motor 114 may be connected to a first cross frame member 140 of the frame 122, and the motor 118 may be connected to a second cross frame member 140 of the frame 122 separate from the first cross frame member. In still further examples, both of the motors 114, 118 may be connected to a single cross frame member 140 of the frame 122. In additional examples, at least one of the motors 114, 118 may be connected to at least one of the rails 136, 138 and/or other components of the frame 122.

Additionally, the frame 122 may include one or more feet 178 configured to contact a support surface 180 on which the deck 112 is disposed, and/or otherwise supported. In such examples, the feet 178 may be adjustable relative to, for example, the rail 136, 138 to which the feet 178 are connected to assist in leveling the deck 112 for use on the support surface 180. For instance, in some examples the support surface 180 may comprise a relatively uneven floor, base, and/or other structure within an exercise facility. In such examples, the feet 178 may be adjusted in order to assist in raising and/or lowering at least part of the deck 112 relative to the support surface 180. As noted above, the motor 114 may be configured to modify an incline, decline, and/or other position of the deck 112 relative to the support surface 180 on which the deck 112 is supported. For example, the motor 114 may be configured to raise, lower, and/or otherwise modify a position of the deck 112, the frame 122, the running surface, and/or other components of the treadmill 102 prior to and/or during use.

In any of the examples described herein, the deck 112 may include one or more linkages 182 connected to the motor 114 (e.g., connected to an output shaft of the motor 114), and such linkages may be configured to assist in modifying the position of the deck 112 relative to the support surface 180. Such a linkage 182 may comprise, for example, one or more shafts, beams, rods, and/or other structures configured to transfer movement, force, torque, rotation, and/or other output from the motor 114 to one or more other components of the deck 112. For example, the deck 112 may also include an incline frame 116 connected to the linkage 182. In some examples, the incline frame 116 may include one or more components connected to the linkage 182 and configured to transfer movement, force, torque, rotation, and/or other output from the linkage 182 to the frame 122 and/or the support surface 180 to assist in modifying the position of the deck 112 relative to the support surface 180.

FIG. 9 shows cross section views of deck 112. For example, at A, a cross section view of the deck 112 shows the first rail 136 and the second rail 138 with cross member 140. In this example, the first rail 136 has a cross section 184. This cross section 184 shows an overhang 186. In various examples, the overhang 186 may be configured to act as a footrail allowing user 106 to step on the first rail 136, for example, if the user 106 needs to stop or step off of the belt 120. At B, a cutaway cross section is shown of the deck 112. In this example, a portion of the overhang 186 protrudes over a portion of the belt 120.

Display and User Interface

The one or more displays 104 may be driven by a user input device such as a touchscreen, mouse, voice control, or other suitable input device. In some examples, the display 104 or at least a portion thereof, may comprise a touchscreen configured to receive touch input from the user 106. The one or more displays 104 may be any size, but optimally are large enough and oriented to allow the display of a range of information including one or more video streams, a range of performance metrics corresponding to the user 106, a range of additional performance metrics associated with one or more additional users exercising on exercise machines remote from the exercise machine 102, and a range of different controls.

In various exemplary embodiments the user can use the display 104 or one or more user interfaces displayed on the display 104 to selectively present a range of different information including live and/or archived video, performance data, and other user and system information. Such user interfaces can provide a wide range of control and informational windows that can be accessed and removed individually and/or as a group by a click, touch, voice command, or gesture. In various exemplary embodiments, such windows may provide information about the user's own performance and/or the performance of other participants in the same class both past and present.

Example user interfaces presented via the display 104 may be used to access member information, login and logout of the system 100, access live content such as live exercise classes and archived classes or other content. User information may be displayed in a variety of formats and may include historical and current performance and account information, social networking links and information, achievements, etc. The user interfaces can also be used to access the system 100 to update profile or member information, manage account settings such as information sharing, and control device settings.

An example user interface may also be presented on the one or more displays 104 to allow users to manage their experience, including selecting information to be displayed and arranging how such information is displayed on the display 104. Such a user interface may present multiple types of information overlaid such that different types of information can be selected or deselected easily by the user 106. For example, performance metrics and/or other information may be displayed over video content using translucent or partially transparent elements so the video behind the information elements can be seen together with (i.e., simultaneously with) the performance metrics and/or other information itself. Further, example the user interfaces may present a variety of screens to the user 106 which the user 106 can move among quickly using the provided user input device, including by touching if a touchscreen is used.

In various exemplary embodiments, the user interfaces may be run through a local program or application using a local operating system such as an Android or iOS application, or via a browser-based system. Any of the performance metrics or other information described herein with respect to the various user interfaces may also be accessed remotely via any suitable network such as the internet. For example, users 106 may be able to access a website from a tablet, mobile phone, computer, and/or any other digital device, and such users 106 may be able to review historical information, communicate with other participants, schedule classes, access instructor information, and/or view any of the information described herein with respect to the various user interfaces through such a website.

Local System

As noted above, an example local system 100 may include an exercise machine 102, and a range of associated sensing, data storage, processing, and/or communications components (e.g., digital hardware 148). In example embodiments, such components may be disposed onboard the exercise machine 102 itself and/or located near the exercise machine 102. The processing, data storage, and/or communications components may be located within a housing of the display 104 to form a single integrated onboard computer and display screen, or they may be separately housed locally on or near the exercise machine 102. Such an example local system 100 may communicate with one or more remote servers through wired or wireless connections using any suitable network or protocol.

Additionally, as noted above, an example exercise machine 102 may be equipped with various sensors 147 to measure, sense, detect, and/or otherwise determine information relating to user performance metrics. Such information may be stored in memory associated with the digital hardware 148 and/or in memory associated with the remote servers, and such information may be used by the processors and/or other components of the digital hardware 148 to determine one or more of the performance metrics described herein and/or to determine other performance information. The exercise machine 102 may also be equipped with or connected to various data input devices or other user interfaces such as the display 104, touchscreens, video cameras, and/or microphones.

The sensors 147 and other input devices can communicate with local and/or remote processing and storage devices via any suitable communications protocol and network, using any suitable connection including wired or wireless connections. In various exemplary embodiments, local communication may be managed using a variety of techniques. For example, local communication may be managed using wired transport with a serial protocol to communicate between sensors and the console. Local communication may also be managed using a wireless communication protocol such as the ANT or ANT+ protocol. ANT is a 2.4 GHz practical wireless networking protocol and embedded system solution specifically designed for wireless sensor networks (WSN) that require ultra-low power. Advantages include extremely compact architecture, network flexibility and scalability, ease of use and low system cost. Various combinations of wired and wireless local communication may also be used.

Access to any appropriate communications network such as the internet may be used to provide information to and receive information from other exercise machines 102 or other resources such as a backend system or platform. In various exemplary embodiments, the local system 100 can access and display information relating to other users either directly through a distributed platform or indirectly through a central platform regardless of their location. Such other users may be present at the same location or a nearby location, or they may be at a remote location.

CLAUSES

The example clauses A-T noted below set forth example embodiments of the present disclosure. Any of the clauses below, or individual features thereof, may be combined in any way. Further, the descriptions included in any of the example clauses below may be combined with one or more features described above or illustrated in FIGS. 1-14. The clauses noted below are not intended to narrow the scope of the present disclosure in any way, and merely constitute examples of the various embodiments described herein.

A. In an example embodiment of the present disclosure, a deck for an exercise machine, the deck comprising: a continuous belt being rotatable about a first roller disposed at a first end at least partly defining a cavity of the deck, and being rotatable about a second roller disposed at a second end of the cavity opposite the first end, the second roller at least partly defining the cavity of the deck; a first motor configured to modify a position of the deck relative to a support surface on which the deck is supported; and a second motor configured to modify a speed of rotation of the belt, wherein the first motor and the second motor are disposed in the cavity of the deck.

B. The deck of clause A, further comprising a substantially rigid frame, at least one of the first motor and the second motor being connected to a component of the frame disposed at least partly within the cavity.

C. The deck of clauses A or B, wherein the first roller is mated with a pulley, the pulley is coupled to the second motor, and the pulley is driven by the second motor.

D. The deck of clauses A through C, further comprising: a linkage connected to the first motor, and an incline frame connected to the linkage, at least part of the incline frame extending external to the cavity and being configured to act on the support surface to modify the position of the deck.

E. The deck of clauses A through D, wherein the position comprises an incline of the deck relative to the support surface.

F. The deck of clauses A through E, further comprising a substantially rigid frame, the frame including a first rail, a second rail opposite the first rail, and at least one cross frame member extending from the first rail to the second rail, the first rail and the second rail forming at least part of the cavity, and at least one of the first motor or the second motor being connected to the at least one cross frame member.

G. The deck of clauses A through F, further comprising a controller, the controller operably coupled to at least one of the first motor or the second motor and configured to control the at least one of the first motor or the second motor.

H. The deck of clauses A through G, further comprising a control cavity, the control cavity disposed at least partially in one or more of the first rail or the second rail.

I. The deck of clauses A through H, wherein at least a portion of the controller is accessible through an opening in one or more of the first rail or the second rail.

J. The deck of clauses A through I, further comprising a control coupled to the controller configured to transmit a signal to the controller for controlling the first motor or the second motor, the control having an audio indication, the audio indication being activated in response to the control being adjusted by a user.

K. The deck of clauses A through J, wherein the second motor comprises: a first flywheel coupled to a motor body at a first end, the first flywheel having a cooling feature configured to cause air to flow across the motor body during operation; and a second flywheel coupled to the motor body at a second end, the second end opposite of the first end.

L. The deck of clauses A through K, wherein first flywheel has a diameter that is less than or equal to a diameter of the motor body.

M. The deck of clauses A through L, wherein first flywheel has a lower mass than the second flywheel.

N. In another example embodiment of the present disclosure, a treadmill, comprising: a deck; an upper assembly connected to the deck and including a crossbar; a display supported by the crossbar; and a controller operably connected to the deck and the display, the deck including: a continuous belt, being rotatable about a first roller disposed at a first end at least partly defining a cavity of the deck, and being rotatable about a second roller disposed at a second end of the cavity opposite the first end, the second roller at least partly defining the cavity of the deck; a first motor configured to modify a position of the deck relative to a support surface on which the deck is supported; and a second motor configured to modify a speed of rotation of the belt, wherein the first motor and the second motor are disposed in the cavity of the deck.

O. The treadmill of clause N, further comprising a substantially rigid frame, at least one of the first motor and the second motor being connected to a component of the frame disposed at least partly within the cavity.

P. The treadmill of clauses N or O, wherein the first roller is mated with a pulley, the pulley is coupled to the second motor, and the pulley is driven by the second motor.

Q. The treadmill of clauses N through P, further comprising: a linkage connected to the first motor, and an incline frame connected to the linkage, at least part of the incline frame extending external to the cavity and being configured to act on the support surface to modify the position of the deck.

R. The treadmill of clauses N through Q, further comprising a substantially rigid frame, the frame including a first rail, a second rail opposite the first rail, and at least one cross frame member extending from the first rail to the second rail, the first rail and the second rail forming at least part of the cavity, and at least one of the first motor or the second motor being connected to the at least one cross frame member.

S. The treadmill of clauses N through R, wherein the second motor comprises: a first flywheel coupled to a motor body at a first end, the first flywheel having a cooling feature configured to cause air to flow across the motor body during operation; and a second flywheel coupled to the motor body at a second end, the second end opposite of the first end.

T. In another example embodiment of the present disclosure, a method of manufacturing a treadmill, comprising: providing a substantially rigid frame having a first rail, a second rail opposite the first rail, a least one at least one cross frame member extending from the first rail to the second rail; connecting a first motor to the frame; connecting a second motor to the frame; and engaging a continuous belt with the second motor, the continuous belt, being rotatable about a first roller disposed at a first end at least partly defining a cavity of a deck, and being rotatable about a second roller disposed at a second end of the cavity opposite the first end, the second roller at least partly defining the cavity of the deck; the first motor is configured to modify a position of the deck relative to a support surface on which the deck is supported; and the second motor is configured to modify a speed of rotation of the belt, wherein the first motor and the second motor are disposed within the cavity of the deck.

CONCLUSION

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the examples and applications illustrated and described, and without departing from the spirit and scope of the present invention, which is set forth in the following claims.

What is claimed is:

1. A deck for an exercise machine, the deck comprising:
a continuous belt
being rotatable about a first roller disposed at a first end at least partly defining a cavity of the deck, and
being rotatable about a second roller disposed at a second end of the cavity opposite the first end, the second roller at least partly defining the cavity of the deck;
a first motor configured to modify a position of the deck relative to a support surface on which the deck is supported;
a second motor configured to modify a speed of rotation of the continuous belt, wherein the first motor and the second motor are disposed in the cavity of the deck; and
a controller disposed in a drawer inside the cavity, the drawer configured to transport at least a portion of the controller inside the cavity.

2. The deck of claim 1, further comprising a substantially rigid frame, the substantially rigid frame including a first rail, a second rail opposite the first rail, and at least one cross frame member extending from the first rail to the second rail, the first rail and the second rail forming at least part of the cavity, and at least one of the first motor or the second motor being connected to the at least one cross frame member.

3. The deck of claim 2, wherein the drawer is disposed at least partially in one or more of the first rail or the second rail.

4. The deck of claim 2, wherein at least the portion of the controller is accessible through an opening in one or more of the first rail or the second rail.

5. The deck of claim 1, wherein the second motor comprises:
a first flywheel coupled to a motor body at a first end, the first flywheel having a cooling feature configured to cause air to flow across the motor body during operation; and
a second flywheel coupled to the motor body at a second end, the second end opposite of the first end.

6. The deck of claim 5, wherein the first flywheel has a diameter that is less than or equal to a diameter of the motor body.

7. The deck of claim 5, wherein the first flywheel has a lower mass than the second flywheel.

8. The deck of claim 1, further comprising a substantially rigid frame, at least one of the first motor and the second motor being connected to a component of the substantially rigid frame disposed at least partly within the cavity.

9. The deck of claim 8, wherein the first roller is mated with a pulley, the pulley is coupled to the second motor, and the pulley is driven by the second motor.

10. The deck of claim 1, further comprising:
a linkage connected to the first motor, and
an incline frame connected to the linkage,
at least part of the incline frame extending external to the cavity and being configured to act on the support surface to modify the position of the deck.

11. The deck of claim 10, wherein the position comprises an incline of the deck relative to the support surface.

12. The deck of claim 1, wherein the controller is operably coupled to at least one of the first motor or the second motor and configured to control the at least one of the first motor or the second motor.

13. The deck of claim 1, further comprising a control coupled to the controller configured to transmit a signal to the controller for controlling the first motor or the second motor, the control having an audio indication, the audio indication being activated in response to the control being adjusted by a user.

14. A treadmill, comprising:

a deck;

an upper assembly connected to the deck and including a crossbar;

a display supported by the crossbar; and a controller operably connected to the deck and the display, the deck including:

a continuous belt, being rotatable about a first roller disposed at a first end at least partly defining a cavity of the deck, and being rotatable about a second roller disposed at a second end of the cavity opposite the first end, the second roller at least partly defining the cavity of the deck;

a first motor configured to modify a position of the deck relative to a support surface on which the deck is supported; and a second motor configured to modify a speed of rotation of the continuous belt, wherein the first motor and the second motor are disposed in the cavity of the deck; and a substantially rigid frame, the substantially rigid frame including a first rail, a second rail opposite the first rail, and at least one cross frame member extending from the first rail to the second rail, the first rail and the second rail forming at least part of the cavity, wherein the controller is disposed in a drawer in the cavity, the drawer configured to transport at least a portion of the controller inside the cavity.

15. The treadmill of claim 14, wherein at least one of the first motor or the second motor being connected to the at least one cross frame member.

16. The treadmill of claim 15, wherein the second motor comprises:

a first flywheel coupled to a motor body at a first end, the first flywheel having a cooling feature configured to cause air to flow across the motor body during operation; and a second flywheel coupled to the motor body at a second end, the second end opposite of the first end.

17. The treadmill of claim 14, wherein at least one of the first motor and the second motor being connected to a component of the substantially rigid frame disposed at least partly within the cavity.

18. The treadmill of claim 14, wherein the first roller is mated with a pulley, the pulley is coupled to the second motor, and the pulley is driven by the second motor.

19. The treadmill of claim 14, further comprising:

a linkage connected to the first motor, and an incline frame connected to the linkage, at least part of the incline frame extending external to the cavity and being configured to act on the support surface to modify the position of the deck.

20. A method of manufacturing a treadmill, comprising:

providing a substantially rigid frame having a first rail, a second rail opposite the first rail, at least one cross frame member extending from the first rail to the second rail;

connecting a first motor to the frame;

connecting a second motor to the frame; and engaging a continuous belt with the second motor, the continuous belt, being rotatable about a first roller disposed at a first end at least partly defining a cavity of a deck, and being rotatable about a second roller disposed at a second end of the cavity opposite the first end, the second roller at least partly defining the cavity of the deck;

the first motor is configured to modify a position of the deck relative to a support surface on which the deck is supported; and the second motor is configured to modify a speed of rotation of the continuous belt, wherein the first motor and the second motor are disposed within the cavity of the deck; and connecting a drawer to the at least one cross frame member, a controller disposed within the drawer and the drawer transporting at least a portion of the controller inside the cavity.

* * * * *